US008393281B1

(12) United States Patent
Chen et al.

(10) Patent No.: US 8,393,281 B1
(45) Date of Patent: Mar. 12, 2013

(54) PARTICLE FEEDER

(75) Inventors: Wei-Yin Chen, Oxford, MS (US); George Gowan, Taylor, MS (US)

(73) Assignee: University of Mississippi, University, MS (US)

( * ) Notice: Subject to any disclaimer, the term of this patent is extended or adjusted under 35 U.S.C. 154(b) by 947 days.

(21) Appl. No.: 12/395,285

(22) Filed: Feb. 27, 2009

Related U.S. Application Data

(60) Provisional application No. 61/031,771, filed on Feb. 27, 2008.

(51) Int. Cl.
*F23K 3/00* (2006.01)

(52) U.S. Cl. ..... 110/108; 110/105; 110/297

(58) Field of Classification Search ..... 110/101 R, 110/108, 109, 110, 104 R, 105, 297, 348
See application file for complete search history.

(56) References Cited

U.S. PATENT DOCUMENTS

| | | | | | |
|---|---|---|---|---|---|
| 2,667,278 | A | * | 1/1954 | Tesch et al. | 414/201 |
| 3,368,948 | A | * | 2/1968 | Humez et al. | 110/101 R |
| 3,675,797 | A | * | 7/1972 | Pries | 414/164 |
| 3,706,387 | A | * | 12/1972 | Tokarz | 414/203 |
| 4,321,034 | A | * | 3/1982 | Taccone | 110/261 |
| 4,512,702 | A | * | 4/1985 | Mailliet et al. | 414/202 |
| 4,917,558 | A | * | 4/1990 | Jenkins | 414/288 |
| 5,017,196 | A | * | 5/1991 | Dewitz | 110/165 A |
| 5,046,908 | A | * | 9/1991 | Cimenti et al. | 414/203 |
| 5,259,123 | A | * | 11/1993 | Garcia-Mallol | 110/245 |
| 5,462,046 | A | * | 10/1995 | Hannah | 110/101 CF |
| 5,829,968 | A | * | 11/1998 | Lonardi et al. | 432/95 |
| 6,745,708 | B2 | * | 6/2004 | Slater et al. | 110/348 |

OTHER PUBLICATIONS

S. Wan, G. Gowan, and W.Y. Chen, Improvements on a gravity-driven low-rate particle feeder, Review of Scientific Instruments, 2009; 80; pp. 073904-1-073904-5.
R. B. Bird, W. E. Stewart, and E.N. Lightfoot, Transport Phenomena, 2nd ed., p. 53 (2001).
R. A. Dictor, "Determination of Complete Temperature Profiles of Singly Burning Pulverized Fuel Particles," M.S. thesis, Massachusetts Institute of Technology, 1979.
H. Kobayashi, "Devolatilization of Pulverized Coal at High Temperatures," PhD Dissertation, Department of Mechanical Engineering, Massachusetts Institute of Technology, Jun. 1976.
Y. H. Song, "Fate of Fuel Nitrogen during Pulverized Coal Combustion," PhD Dissertation, Department of Chemical Engineering, Massachusetts Institute of Technology, Jun. 1978.
P. R. Solomon, and D. G. Hamblen, "Analysis of Coal Devolatilization in a Laboratory-Scale Entrained Flow Reactor," Fianl Repor AP-2603 under EPRI Project 1654-8, Electrical Power Research Institute, Palo Alto, California, Jul. 1983.

* cited by examiner

*Primary Examiner* — Kenneth Rinehart
*Assistant Examiner* — David J Laux
(74) *Attorney, Agent, or Firm* — Stites & Harbison PLLC; Mandy Wilson Decker

(57) ABSTRACT

A particle feeder is provided for feeding small particles at a uniform low feed rate. In some embodiments, the particle feeder includes a primary reservoir, a secondary reservoir, and a valve. The primary reservoir encloses an internal volume for holding particles and defining a hole through a bottom surface thereof. The valve includes a rod enclosed within and extending through the volume defined by the primary reservoir. The rod is movable between an open position, wherein particles can flow through the hole, and a closed position, wherein the rod blocks the hole. The actuator controls the movement of the rod between the open position and the closed position. The secondary reservoir has an internal volume, and a conduit for connecting the internal volume of the secondary reservoir with the internal volume of primary reservoir, such that particles can flow from the secondary reservoir into the primary reservoir.

15 Claims, 11 Drawing Sheets

PARTICLE FEEDER

RELATED APPLICATIONS

This application claims priority from U.S. Provisional Application Ser. No. 61/031,771 filed Feb. 27, 2008, the entire disclosure of which is incorporated herein by this reference.

GOVERNMENT INTEREST

Subject matter described herein was made with government support under Grant Number CTS-0122504 awarded by National Science Foundation. The government has certain rights in the described subject matter.

TECHNICAL FIELD

The presently-disclosed subject matter relates to particle feeders and systems including particle feeders. In particular, the presently-disclosed subject matter relates to particle feeders for feeding small particles at uniform feed rates.

BACKGROUND

For manufacturing, research, and other application, it can be desirable to feed particles at uniform feed rates over a period of time. However, available particle feeders are unable to maintain desired uniform feed rates, particularly for small particles, at low feed rates, for longer periods of time. Accordingly, there remains a need in the art for an improved particle feeder.

SUMMARY

The presently-disclosed subject matter meets some or all of the above-identified needs, as will become evident to those of ordinary skill in the art after a study of information provided in this document.

This Summary describes several embodiments of the presently-disclosed subject matter, and in many cases lists variations and permutations of these embodiments. This Summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this Summary or not. To avoid excessive repetition, this Summary does not list or suggest all possible combinations of such features.

The presently-disclosed subject matter includes a particle feeder for feeding particles at a desired uniform feed rate. The particles can be for example, coal particles or biomass particles. The particle feeder includes a primary reservoir and a valve. The primary reservoir encloses an internal volume for holding particles and defining a hole through a bottom surface thereof. The valve includes a rod enclosed within and extending through the volume defined by the primary reservoir. The rod is movable between an open position, wherein particles can flow through the hole, and a closed position, wherein the rod blocks the hole. The actuator controls movement of the rod between the open position and the closed position.

In some embodiments, the feeder also includes a timer for controlling the actuator. In some embodiments, the actuator is a solenoid actuator. In some embodiments, a second solenoid actuator is provided for moving the rod into the closed position.

In some embodiments, the primary reservoir includes a removable cap for providing access to the internal volume of the primary reservoir. The cap can be positioned at different heights above the hole to adjust a traveling distance of the rod when the rod is moved between the open position and the closed position. In some embodiments, the cap is constructed from a nonmagnetic material. In some embodiments, the primary reservoir includes a substantially conical floor, with an internal lateral surface directed downward towards an apex, said hole being defined at the apex.

In some embodiments, the rod includes a substantially conical tip for nesting within the apex of the floor, thereby sealing the hole in the closed position. In some embodiments, the rod can be adjusted to different lengths to change a traveling distance of the rod when said rod is moved between the open position and the closed position. In some embodiments, the rod comprises a magnetic material.

In some embodiments, the particle feeder also includes a secondary reservoir having an internal volume, and a conduit for connecting the internal volume of the secondary reservoir with the internal volume of primary reservoir, such that particles can flow from the secondary reservoir into the primary reservoir.

The presently-disclosed subject matter includes a system having a particle feeder for feeding particles at a desired uniform feed rate into a reactor. The system includes the particle feeder and the reactor. The particle feeder can be an embodiment of the particle feeder as described above. The reactor has an internal area placed in fluid communication with the internal volume of the primary reservoir, such that particles flowing through the hole can enter the internal area of the reactor.

In some embodiments, the system also includes a series of lines and valves for exposing the system to a gas or a vacuum. The series of lines can include a first line in fluid communication with the internal volume of the primary reservoir, for exposing the internal volume of the primary reservoir to a gas or a vacuum; a second line in fluid communication with the internal area of the reactor for exposing the internal area of the reactor to the gas or the vacuum; and an equilibrium line placed in fluid communication with the first and second lines. The series of valves are provided for controlling exposure of the internal volume of the primary reservoir and the internal area of the reactor to the gas or the vacuum.

In some embodiments, the system also includes an analytical instrument operably connected to the reactor.

DESCRIPTION OF EXEMPLARY EMBODIMENTS

The presently-disclosed subject matter includes a particle feeder for feeding particles at a desired uniform feed rate. The particle feeder includes a reservoir and a valve. The reservoir encloses an internal volume for holding particles, and defines a hole through a bottom surface thereof. The valve includes a rod and an actuator, which controls movement of the rod. The rod is enclosed within and extends through the volume defined by the reservoir. When the valve is moved into an open position, particles can flow through the hole defined by the reservoir. When the valve is moved into a closed position, the hole is blocked, keeping particles from escaping the reservoir.

Figure 1:
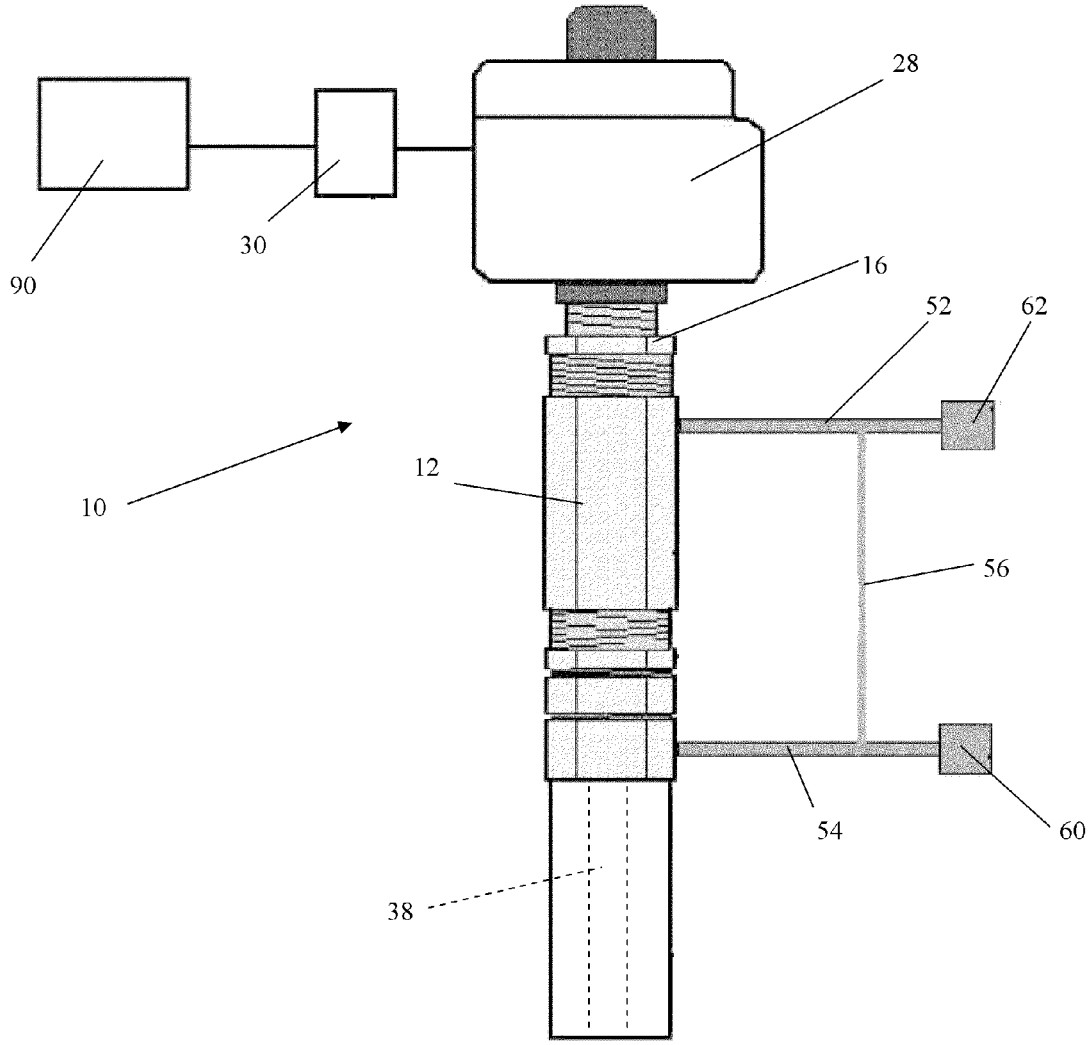
FIG. 1 is a schematic depiction of an embodiment of a particle feeder as described in the present application.
Figure 2A:
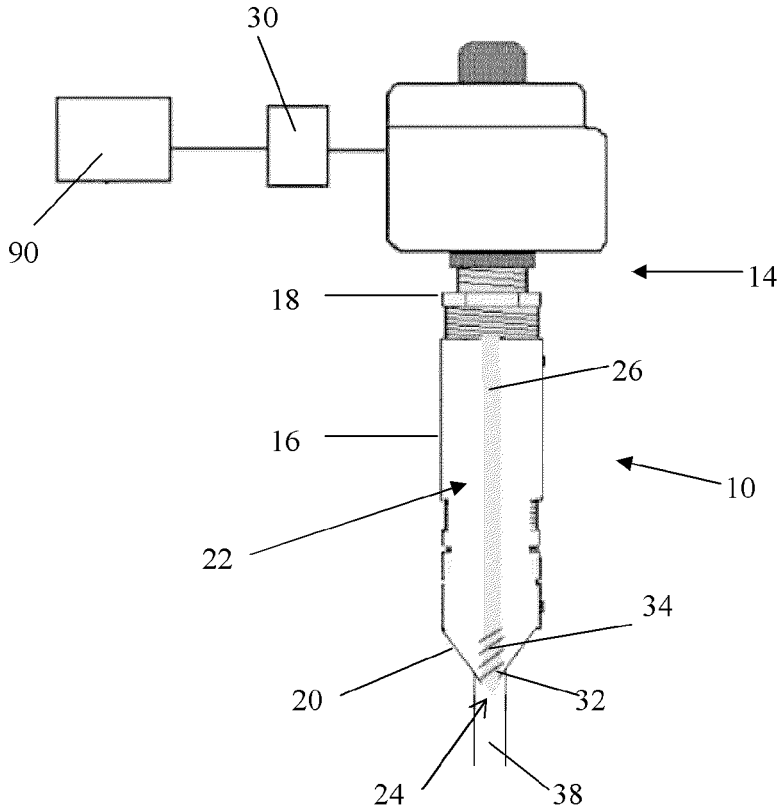
FIG. 2A is a schematic depiction of the particle feeder of FIG. 1, with a view of the inside of the reservoir, showing the rod of the valve in the closed position.
Figure 2B:
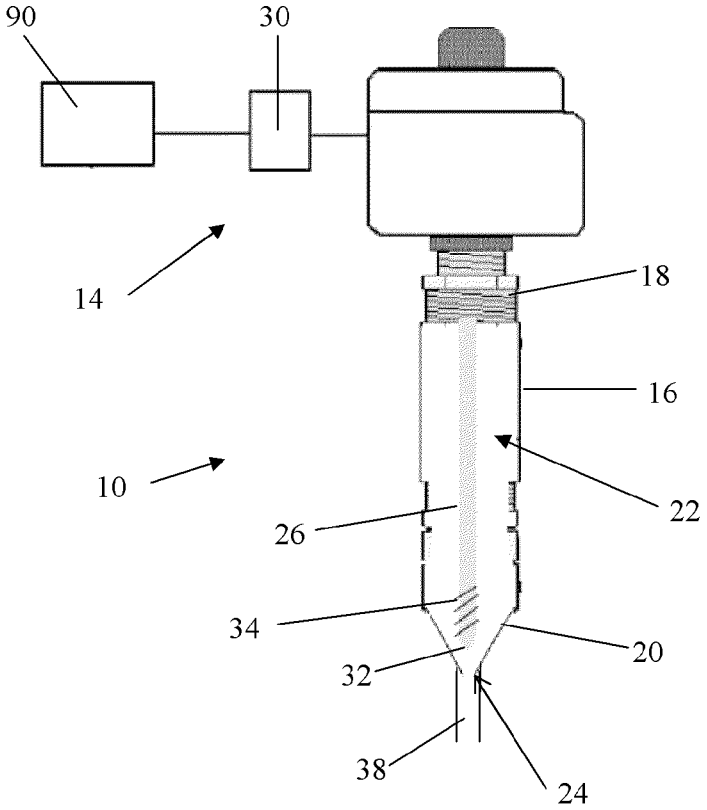
FIG. 2B is a schematic depiction of the particle feeder of FIG. 1, with a view of the inside of the reservoir, showing the rod of the valve in the open position.

With reference to FIGS. 1, 2A, and 2B, in some embodiments, the reservoir 12 of the particle feeder 10 includes a wall 16, a cap 18, and a floor 20, defining the internal volume 22 for holding particles for feeding. The floor 20 of the reservoir 12 defines a hole 24 though which particles can exit the reservoir 12. As will be understood by those skilled in the art, the hole 24 should be sized to allow a particle or particles to flow therethrough, as desired, which size will vary depending on the application in which the particle feeder 10 is being used, the size and nature of the particles, etc.

As will be understood by those skilled in the art, the reservoir 12 can be any shape that allows particles to flow freely, under force of gravity, through the internal volume 22. In some embodiments, the reservoir 12 is substantially cylindrical, with a circumferential wall 16. It can be desirable for the reservoir 12 to be designed to facilitate the flow of particles toward the hole 24. In this regard, in some embodiments, the floor 20 is shaped like an inverted cone, where the hole 24 is defined in an apex of the cone such that particles can flow down an internal lateral surface of the cone, towards the apex, and through the hole 24. As will be understood by those skilled in the art upon studying this application, the desirable particle volume and/or mass capacity of the reservoir 12 will vary depending on the application in which the particle feeder 10 is being used, the size and nature of the particles, etc. The reservoir 12 can be constructed from any material of sufficient strength and durability for operation of the particle feeder. In embodiments that include a solenoid actuator, as mentioned below, it can be desirable to use a nonmagnetic material (e.g., a material that does not contain iron), such a stainless steel, brass, or acrylic. In some embodiments, the reservoir 12 has an integral construction. In some embodiments, the reservoir 12 has discrete structural elements that are secured to one another. For example, the wall 16, cap 18, and floor 20 could be provided as discrete structural elements that are secured to one another to form the reservoir 12 and enclose the internal volume 22. In such embodiments, the wall 16, cap 18, and floor 20 could be constructed from different materials, for example, the wall 16 could be stainless steel, while the cap 18 and the floor 20 could be brass.

With continued reference to FIGS. 1, 2A, and 2B, in some embodiments, the valve 14 of the particle feeder 10 includes a rod 26, and an actuator 28 for controlling movement of the rod 26. The rod 26 is moveable within the space 22 of the reservoir 12 between a closed position and an open position. With reference to FIG. 2A, when the rod 26 is in the closed position, it blocks the hole 24 to keep particles from escaping the reservoir 12. With reference to FIG. 2B, when the rod 26 is in the open position, it is lifted away from the hole 24 and particles are allowed to flow through the hole 24.

As will be understood by those skilled in the art, the rod 26 can be any shape, so long as it does not interfere with the flow of particles from the reservoir 12, and it is capable of movement within the internal volume 22, i.e., it should not abut the wall 16 of the reservoir 12 in a manner that unduly restricts its movement or unduly limits the internal volume 22 of the reservoir 12. As will also be understood by those skilled in the art, the length of the rod 26, relative to its diameter, can be important for maintaining a desired structural stability of the rod 26. As is noted below, in some embodiments, the length of the rod 26 can affect feed rate, in so far as it can alter the traveling distance of the rod 26 from the hole 24, and therefore can alter the time period that hole 24 is accessible to particle flow.

The actuator 28 can be of any type that is capable of controlling movement of the rod 26, and communicating with the timer 30, for example, an electric actuator, a pneumatic actuator, or a hydraulic actuator can be used. In some embodiments, a solenoid actuator is used; for example, Model SS251 12 V starter solenoid available from Standard Motor Products, Inc. (Long Island City, N.Y.) can be used. In some embodiments, an actuator 28 is employed to lift the rod 26 into the open position, before releasing the rod 26 and allowing it to fall by force of gravity into the closed position. In some embodiments, an actuator 28 is also used to pull the rod 26 down into the closed position. For example, in some embodiments, two solenoid actuators can be used, a first to lift the rod into the open position, and a second to pull the rod into the closed position.

The rod 26 can be constructed from any material that is of sufficient strength and durability for operation of the particle feeder. In embodiments of the particle feeder 10, which makes use of a solenoid actuator 28, the rod 26 includes material capable of interacting with and being lifted by the magnetic field generated by the solenoid actuator 28, such as a magnetic material, e.g., magnetic metal. In some embodiments, the rod 26 is constructed from a metal containing iron, nickel, and/or cobalt. In some embodiments, the rod 26 is constructed from steel. In some embodiments, the rod 26 includes a segment constructed from a metal containing iron, nickel, and/or cobalt. In some embodiments, the rod 26 includes a segment constructed from steel.

It is noted that, when magnetic metals are exposed to a magnetic field for periods of time, they can become permanently magnetized. In this regard, as will be understood by those skilled in the art upon studying this application, when a solenoid actuator is used, consideration should be given to the materials selected for certain components of the particle feeder, to avoid undesired results of components of the particle feeder becoming permanently magnetized. For example, in some embodiments, the cap 18 of the reservoir 12 is situated between the rod 26 and the solenoid actuator 28 of the valve 14. If the cap 18 of the reservoir 12 becomes permanently magnetized, the rod 26 can stick in the open position, hindering operation of the particle feeder 10. This undesirable result can be avoided by constructing the cap 18 from a non-magnetic material, such as brass or stainless steel. For another example, this undesirable result can be avoided by including a buffering structure at the top of the rod, constructed from a non-magnetic metal, to keep the rod from sticking in the open position. For example, the top of the rod can be threaded to accept a stainless steel nut, serving as the buffering structure.

In some embodiments, it can be desirable to apply a coating, such as a plastic coating, on the base of the rod before running the particle feeder to facilitate sealing of the hole when the rod is in the closed position. When such a coating is used, it should be applied uniformly, and should be reapplied as needed. A spray-on plastic coating can be used, such as, Liquid Plastic, which is widely available commercially, for example, from Wal-Mart Stores, Inc. Use of the Liquid Plastic brand plastic coating is most convenient when it is desired to run the particle feeder for time periods approximately less than 1 or 2 hours, because the plastic coating may need to be reapplied periodically.

The rod 26 can further comprises a tip 32, shaped to provide a seal with the floor 20 of the reservoir 12 defining the hole 24, to keep particles from escaping from the reservoir 12 when the rod 26 is in the closed position. For example, in embodiments where the floor 20 is conical, the tip 32 can likewise be conical, such that it can nest within the apex of the conical floor 20, snuggly sealing the hole 24. The tip 32 can be integral with the rod 26, or can be a distinct structure that is connected to the base of the rod 26.

The tip 32 of the rod 26 can be constructed from any material, which is of sufficient strength and durability for operation of the particle feeder, and which has properties for achieving a surface capable of nesting within the apex of the conical floor 20 to seal the hole, e.g., a smooth surface can be desirable. In some embodiments, the tip 32 can be constructed from brass, aluminum, or stainless steel. In some embodiments, it can be desirable for the tip 32 to be constructed from a material capable of interacting with a magnetic field generated by a solenoid actuator, such as a magnetic metal. In this regard, in some embodiments, the tip 32 can be constructed from a metal containing iron, nickel, and/or cobalt. However, in embodiments, such as embodiments that make use of a second solenoid actuator for pulling the rod into the closed position, if the tip 32 becomes permanently magnetized, the rod 26 can stick in the closed position, hindering operation of the particle feeder 10. In this regard, in some embodiments, it can be desirable for the tip 32 to be constructed from a non-magnetic material.

In some embodiments, when the particle feeder 10 is being run for longer periods of time, it can be desirable to include a wire 34 wrapped around the base of the rod 26, or similar structural projection extending from the base of the rod 26. Such a structure can serve to disturb the particles contained in the reservoir 12 when the rod 26 moves, reducing caking of the particles in the reservoir 12.

As noted above, the rod 26 is moveable between the open position and the closed position. The rod 26 movement is substantially longitudinal within the volume 22 of the reservoir 12. The rod 26 can be held in a substantially vertical position for such longitudinal movement in a number of manners. In some embodiments, the internal volume of the reservoir and the diameter of the rod are such that the rod is held substantially vertically by the reservoir itself. In some embodiments, the rod can have a first diameter, and can include a segment having a second, larger diameter. When positioned within the reservoir, the segment of the rod separates the rod from the internal wall of the reservoir, holding it substantially vertically within the internal volume of the reservoir. The segment can be integral with the rod, or it can be a discrete structure that is attached to the rod. In some embodiments, the rod can be threaded, and the segment can be screwed onto the rod, e.g., a nut can be used. In some embodiments, a guide is employed to hold the rod in a substantially vertical position for longitudinal movement. The guide can have a substantially planar structure, affixed to the internal walls of the reservoir, or to the cap of the reservoir, and defining an aperture in which the rod can move longitudinally.

Figure 3:
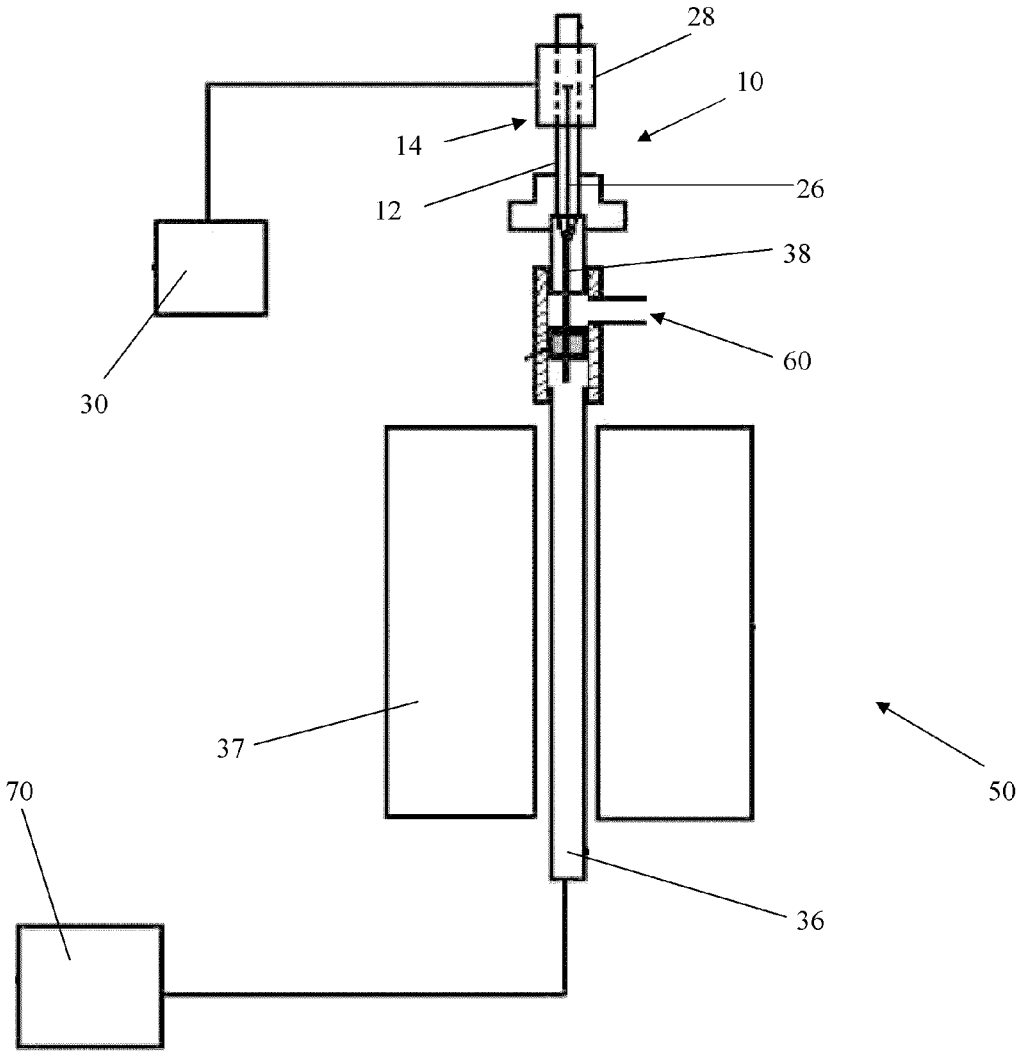
FIG. 3 is a schematic depiction of an exemplary system including an embodiment of a particle feeder as described in the present application.

With reference to FIG. 3, an exemplary application the feeder 10 will now be described. The particle feeder 10 can be used to deliver particles to an internal area of a reactor 36. When the feeder 10 is used as part of a system 50 including a reactor 36, the internal volume 22 of the reservoir 12 is placed in fluid communication with the internal area of the reactor 36. That is to say that particles can flow from the reservoir 12 into the reactor 36 when the rod 26 is in the open position. In some embodiments, it can be desirable to have a sealed system, wherein there is fluid communication between the internal area of the reactor 36 and the internal volume 22 of the reservoir 12, but not with the environment outside of the system 50.

In some embodiments, it can also be desirable to control the content and pressure of the atmosphere of the system 50. In this regard, the system 50 can further include a series of lines and valves for delivering and removing gas to the system 50. With reference to FIG. 1, in some embodiments a first line 52 is placed in fluid communication with the internal volume 22 of the reservoir 12, a second line 54 is placed in fluid communication with the internal area of the reactor 56, and an equilibrium line 58 is placed in fluid communication with the first line 52 and the second line 54. A gas inlet 60 and a vacuum 62 are placed along the series of lines 52, 54, 56 for purging and evacuating the system 50. As will be understood by those skilled in the art, valves are placed along the series of line 52, 54, 56 so that gas and vacuum flow to the internal volume 22 of the reservoir 12, the internal area of the reactor 36, or both can be controlled. In this manner, inert or reactive gas can be delivered to the system 50, as desired. Similarly, pressure within the internal volume 22 of the reservoir 12 and the internal area of the reactor 36 can be controlled as desired.

For many applications, it can be desirable to maintain substantially the same pressure within the internal volume 22 of the reservoir 12 and the internal area of the reactor 36, which can be accomplished by opening the equilibrium line 58 to fluid communication with the first line 52 and second line 54, as will be understood by those skilled in the art. For other applications, it can be desirable to maintain a pressure differential at the hole 24 through which particles exit the reservoir 12, which can be accomplished by closing the equilibrium line 58 to fluid communication with the first line 52 and second line 54, and adjusting the relative pressures as desired, as will be understood by those skilled in the art. It can be desirable to maintain a pressure differential, for example, to control feed rate, or to facilitate feeding of particular types of particles. When the pressure within the internal area of the reactor 36 is greater, it can slow the feed rate. Conversely, when the pressure within the internal volume 22 of the reservoir 12 is greater, it can urge particles through the hole 24 towards the reactor 36. The ability to urge particles through the hole 24 using a pressure differential can be particularly useful when the particles are provided in a liquid slurry.

With reference to FIGS. 1 and 3, it can be desirable to strategically place the second line 54 a distance below the hole 24 to minimize disruption of particle flow by movement of gas. As will be understood by those skilled in the art, the ideal distance will depend on the application, internal pressure(s), particle type, particle size, etc. In some embodiments, where fine coal particles of about 70-100 μm are being fed, it can be desirable to place the second line at least about 2-3 inches below the hole. To further protect the particle flow from disruption by movement of gas, a transport tube 38 can be employed. The transport tube 38 is placed in fluid communication with the internal volume 22 of the reservoir 12, such that particles can fall through the hole 24, through the transport tube 38, past the second line 54, and into the reactor 36. In this manner, as the particles flow past the second line the second line 54, they are protected from the movement of gas by the transport tube 38.

The transport tube can serve other purposes as well. For example, it was unexpectedly found that a transport tube of sufficient length, between and connecting the internal volume 22 of the reservoir 12 and the internal area of the reactor 36, results in more homogeneously sized particles being delivered to the reactor 36. The ideal length will depend on the application, internal pressure(s), particle type, particle size, etc. In some embodiments, where fine coal particles of about 70-100 μm are being fed, it can be desirable for the transport tube to be at least about 1-2 feet in length.

For another example, the transport tube can be used to provide a custom fit between the feeder and a reactor, or other piece equipment or device with which the feeder is being used. For example, suppose that the feeder is being used to feed particles into a reactor having a particularly-sized opening, e.g., 1/16 inch diameter, that differs from the size of the hole defined by the reservoir, e.g., 1/8 inch diameter. In such an example, the transport tube can be provided in segments of different sizes, e.g., a first segment of 1/8 inch diameter, a second segment of 1/4 inch diameter, and a third segment of 1/16 inch diameter, such that a first segment is capable of mating with the hole defined by the reservoir, and another segment is capable of mating with the opening of the reactor.

With reference to FIG. 3, it is noted that a system 50 including a feeder 10 can further include an analytical instrument 70. Examples of analytical instruments that can be included are: a gas chromatographer/mass spectrometer (GC/MS), and a Fourier transform infrared spectrometer (FTIR).

Referring again to FIGS. 1, 2A, and, 2B, the particle feeder 10 can be operated in the following exemplary manner. Particles of interest, of a desired type and size are selected. Particle types will depend on the application, but examples include, coal, biomass, powders, pharmaceutical compositions, and the like. Generally, dried particles can be fed with greater ease; however, liquids containing particles, including suspensions, and slurries can also be used. When liquids containing particles are being used, it is believed that providing the liquids in low concentrations with small particle sizes will achieve the best results. As noted herein, when slurries are being used, it can be beneficial to create a pressure differential to urge the slurry particles through the hole 24 defined by the reservoir 12. It is often desirable to feed particles that are substantially homogeneous in size, or within a particular size range. In this regard, before placing particles in the reservoir 12 for feeding, they can be fed through a sieve, or otherwise size selected. Particles can be as small as about 35, 40, 45, 50, 55, 60, 65, 70, 75, 80, 85, 90, 95, or 100 μm. Particles can be of a size capable of passing through a commercially-available sieve of 35, 74, 88, 104, 124, 147, 175, 208, 246, 295, 351, 417, 495, 589, 701, 833, or 991 μm. Particles can be up to about 1 mm, or larger, as desired.

The cap 18 is removed to expose the internal volume 22 of the reservoir 12, the rod 26 is positioned substantially vertically in the reservoir 12, such that the tip 32 blocks the hole 24 and the rod 26 can freely move substantially longitudinally. A weighted sample of the particles of interest is poured into the reservoir 12. As noted herein, the capacity of the reservoir 12 and the weight and/or volume of particles housed in the reservoir 12 for deliver can vary depending on the application, particle size, type of particle, etc.; however, in some embodiments, when coal particles of about 70-100 μm are being used, the reservoir 12 can have a volume of about 200 $cm^3$ and about 150 gm of particles can be poured into the reservoir 12 for feeding.

As noted below, the traveling distance of the rod 26 can affect flow rate, i.e., the shorter the traveling distance, the lower the feed rate. In embodiments where a nut is provided at the top of the rod for adjusting the traveling distance of the rod, the nut can be rotated to adjust the traveling distance, as desired. In embodiments where the reservoir cap 18 is threaded to be secured at different heights relative to the hole 24, for adjusting the traveling distance of the rod 26, the cap 18 can be secured at a desired height. In any event, the cap 18 is replaced, enclosing the rod 16 and the particles of interest within the interior volume 22 of the reservoir 12.

The rod 16 is placed in communication with the actuator 28, so that the actuator 28 can control the movement of the rod 16. The actuator 28 is placed in communication with a timer 30, for controlling the actuator 28, thereby controlling the frequency that the rod 16 is placed in the open position. A power supply 90 is provided for the actuator 28 and the timer 30. In embodiments of the feeder 12 making use of a solenoid actuator 28, the solenoid actuator 28 is placed above the reservoir cap 18.

The internal volume 22 of the reservoir 12 is placed in fluid communication with a desired device or piece of equipment (e.g., reactor, analytical equipment, capsule for housing a pharmaceutical composition, etc.). In some embodiments, an external surface of the reservoir 12 is threaded to facilitate ease of attachment of a mating portion of the desired device or piece of equipment, thereby sealing the internal volume and area of the system. In some embodiments, a transport tube 38 is placed in fluid communication with the internal volume 22 of the reservoir 12 before the system is sealed.

The particle feeder 10 is designed such that all components that move while the feeder 10 is running, i.e., the rod 26 of the valve 14, are enclosed within the internal volume 22 of the reservoir 12. The lack of external moving components of the particle feeder 10 limits undesirable air leakage, from the system, which air leakage can result in disruption in uniformity of the feed rate. Additionally, this design allows feeding of particles into a gas of any desired composition, without air interference. Such air interference can induce undesired oxidation of the particles and impair data integrity when the particle feeder is being used as part of a system including, for example, a reactor and analysis equipment.

Figure 4:
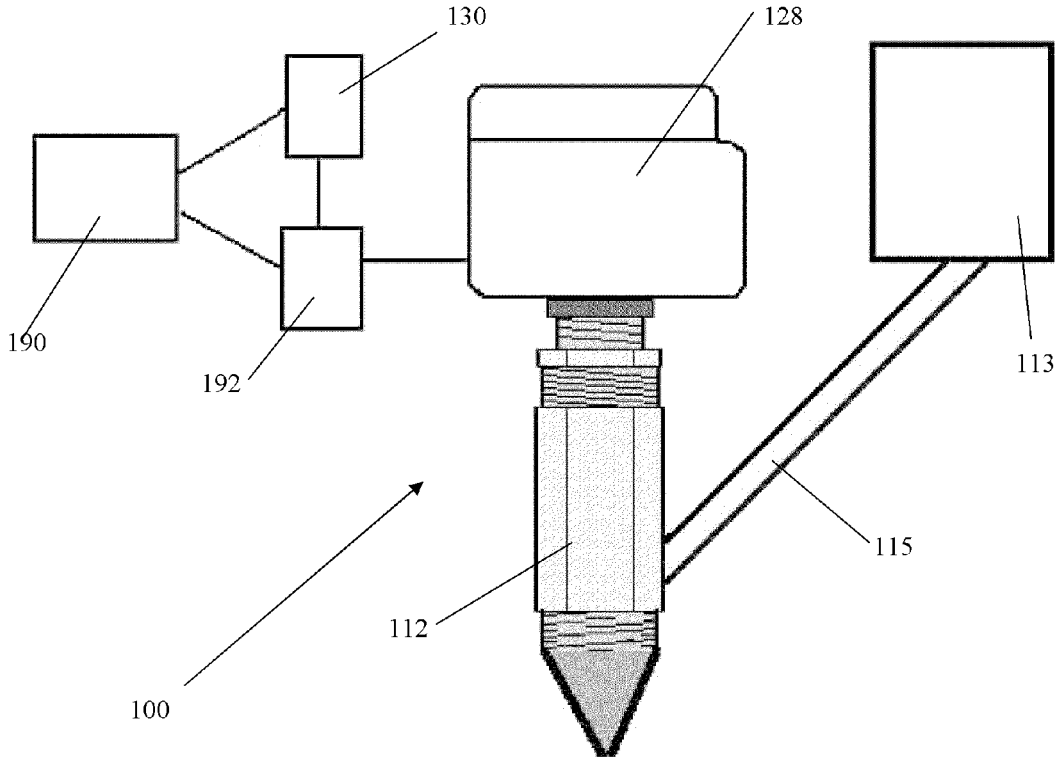
FIG. 4 is a schematic depiction of an embodiment of a particle feeder as described in the present application, including a secondary reservoir.

It can sometimes be desirable to run the particle feeder for relatively long periods of time, e.g., 10 hours. With reference to FIG. 4, in some embodiments, the particle feeder 100 can include a secondary reservoir 113, and a conduit 115 for delivering particles from the secondary reservoir 113 to the primary reservoir 112. The secondary reservoir 113 provides additional volume for housing particles, and can also be conveniently refilled while the feeder 100 is operating.

In addition to allowing for a long-term supply of particles, the secondary reservoir 113 can confer other benefits, including facilitating stability of particle size and uniformity of feed rate. For example, for some applications, it can be desirable to limit particle residence time in the primary reservoir 112. A volume of particles in the primary reservoir 112 can settle for form a bed. Variation in the density of this particle bed can result in disruption in uniformity of the feed rate. As noted above, a wire wrapped around the base of the rod can provide disturbance of particles adjacent the rod to achieve an acceptable density of the particle bed for some applications; however, in embodiments making use of a secondary reservoir 113, variation in the density of the particle bed can be controlled by limiting the particle residence time in the primary reservoir 112. Use of the secondary reservoir 113 also allows variation in the uniformity of the particle bed in the radial direction to be avoided.

Limiting the particle residence time in the primary reservoir 112 can also serve to limit particle attrition, or the unintended breakage of particles. Particle attrition results in not only smaller particle size and non-uniform size distribution, but can also result in a particle bed with an increased density, creating an obstacle for precise movement of the rod of the valve. While a uniform size of smaller volumes of particles can be more readily maintained, when larger volumes are used, particles tend to agglomerate, disturbing the uniformity of the feed rate.

The secondary reservoir 113 can be constructed from any material that is capable of being pressurized, for example, a metal, such as brass, or a polymeric material, such as PVC. In some embodiments, the secondary reservoir 113 is constructed from PVC. The conduit 115 can be constructed from any material such as metals or polymeric materials, e.g., stainless steel, brass, PVC, acrylic. In some embodiments, the conduit 115 is constructed from acrylic.

As will be understood by those skilled in the art upon studying this application, the desirable particle volume and/or mass capacity of the reservoirs will vary depending on the application of the particle feeder, the size and nature of the particles, etc.

As will be understood by those skilled in the art, the secondary reservoir 113 and the conduit 115 can be any shape that allows particles to flow freely, under force of gravity, from the secondary reservoir 113, through the conduit 115, and into the internal volume 22 of the reservoir 112. In some embodiments, it can be desirable have specific control over the flow of particles from the secondary reservoir 113 into the primary reservoir 112. For example, it may be useful to limit particle residence time in the primary reservoir 112 by controlling the flow of particles from the secondary reservoir 113 into the primary reservoir 112. For another example, it may be desirable to feed a single particle, or a small number of particles using the feeder 100, which could be facilitated by delivering only a single or a small number of particles from the secondary reservoir 113 into the primary reservoir 112 during a particular cycle of the feeder valve. This can be accomplished, for example, by providing a valve for controlling flow of particles from the secondary reservoir 113, which is the same or similar to the valve 14 described above with reference to the primary reservoir 112.

When the particle feeder of the present application is operated, it can be described as running through a plurality of cycles, wherein each cycle includes the rod being lifted into the open position, a particle or particles falling through the hole, and the rod returning to the closed position. The flow rate achieved by the feeder can be defined in terms of the weight of particles fed per period of time (e.g., grams/minute), the number of particles fed per period of time (e.g., particles per minute), or the volume of particles fed per period of time (e.g., mL per minute). The flow of particles can also be described in terms of particles, weight, or volume fed per cycle.

Flow rate of the feeder can be calibrated in a number of manners, including the following. The timer can be used to control the frequency with which the actuator lifts the rod into the open position, allowing particles to flow through the hole. In some embodiments, the rod is returned to the closed position under force of gravity. As such, the traveling distance of the rod from the hole correlates to the time taken for the rod to return to the closed position after being released by the actuator, and therefore correlates to the time that particles are allowed to flow through the hole. The traveling distance of the rod can be controlled in a number of ways. For example, traveling distance of the rod can be physically restricted by the reservoir. As such, the rod itself can be provided in a particular length, relative to length of the reservoir to provide for a particular traveling distance. The traveling distance of the rod can be physically restricted by other more readily adjustable means. For example, the cap of the reservoir can be designed to be secured to enclose the internal volume at different heights relative to the hole, e.g., the cap can be threaded to be secured at different heights relative to the hole, for adjusting the traveling distance of the rod. For another example, the rod can be threaded for securing a nut at the top of the rod. The nut can be moved upward or downward to adjust the overall length of the rod, and therefore the traveling distance of the rod.

In some embodiments, an actuator, under the control of a timer, can also be provided to pull the rod down into the closed position. In such embodiments, the flow rate can be calibrated by timed and coordinated actuation of the rod upward into an open position, and downward into a closed position. It is further contemplated that the flow rate could be controlled by generated a desired pressure differential at the hole defined by the reservoir, or by adjusting the size of the hole itself.

The particle feeder of the present application can be used to deliver particles at a desired uniform flow rate. Such desired uniform flow rate can include a low uniform flow rate. The particle feeder can further be used to deliver fine particles at a low uniform flow rate. As used herein, the term "uniform flow rate" refers to a flow rate that is within ±3% in some embodiments, within ±5% in some embodiments, within ±8% in some embodiments, and within ±10% in some embodiments. As used herein, the term "low flow rate" refers to a flow rate that is about 45-100 μm to about 4-5 mg per minute. Such a flow rate can be equivalent to feeding about 10 or fewer particles per cycle, depending on the size of the particle, e.g., it is contemplated that a single particle of about 1 mm could be fed in a single cycle. In this regard, it is contemplated that the particle feeder could be used for single particle injection applications. As used herein the term "low uniform flow rate" refers to a low flow rate that [use same language used to define "uniform flow rate"]. As used herein, the term "fine particles"

refers to particles at least about as small as 100, 95, 90, 85, 80, 75, 70, 65, 60, 55, 50, 45, 40, or 35 μm In some embodiments, the term "fine particles" refers to particles of a size capable of passing through a commercially-available sieve of 35, 74, 88, 104, 124, 147, 175, 208, 246, 295, 351, 417, 495, 589, 701, 833, or 991 μm.

As will be apparent to those skilled in the art upon studying the present application, the particle feeder described herein can have utility in a variety of manufacturing and research applications. For example, it can be used for to deliver particles to a reactor and/or to analytical equipment for research applications, it can be provided in a scale for use in coal gasification processes, or it can be used to deliver metered amounts of pharmaceutical compositions to capsules.

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

While the terms used herein are believed to be well understood by one of ordinary skill in the art, definitions are set forth to facilitate explanation of the presently-disclosed subject matter.

Unless defined otherwise, all technical and scientific terms used herein have the same meaning as commonly understood by one of ordinary skill in the art to which the presently-disclosed subject matter belongs. Although any methods, devices, and materials similar or equivalent to those described herein can be used in the practice or testing of the presently-disclosed subject matter, representative methods, devices, and materials are now described.

Following long-standing patent law convention, the terms "a", "an", and "the" refer to "one or more" when used in this application, including the claims.

Unless otherwise indicated, all numbers expressing dimensions of structures and particles, and properties such as operating conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of length, diameter, mass, weight, time, volume, or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

The presently-disclosed subject matter is further illustrated by the following specific but non-limiting examples.

EXAMPLES

Example 1

An exemplary particle feeder was selected for testing efficacy for coal pyrolysis and oxidation. With reference to FIG. 3, the particle feeder 10 was placed in communication with a reactor 36. The reactor was a straight alumina tube, 99.8% of $Al_2O_3$, 1.91 cm I.D., 2.54 cm O.D., 864 mm in length, from McDanel Advanced Ceramic Technologies. The reactor 36 was vertically placed in a furnace 37. A Lindberg/Blue M Model 54494-V furnace equipped with ten heating elements of 30.48 cm in length was used. The furnace temperature can be brought up to 1700° C. by a programmable controller, Lindberg/Blue M Model 59256-P-COM. The reactor 36 was placed in communication with a analytical instrument 70. A gas chromatograph/mass spectrometer was selected as the analytical instrument for the study. Pyrolysis products were analyzed by an online Agilent Technologies 6890 gas chromatograph and 5973N mass spectrometer (GC/MS). Data were recorded on an online computer. The transport time between the reactor and the GC/MS is typically 20 s.

Before the pyrolysis or oxidation, 2 g of dried, pulverized Illinois No. 6 coal or lignite of 120-140 mesh was placed in the reservoir. It was purged by ultra high pure helium (He) three times. Particles were fed using two different modes: a batch mode (low frequency or manual control) and a continuous mode (high frequency). Pyrolysis was performed with the batch mode with 1 s opening time using Illinois No. 6 coal. Each feed was controlled manually. Particles were fed into the preheated reactor at 850° C. with flowing He at 800 cc/min. Oxidation was performed with two continuous injection modes: 9 s intervals with 0.1 s opening times and 0.4 s intervals with 0.02 s opening times. Particles were fed into the preheated reactor at 900° C. with flowing gas mixture containing 1 or 2% $O_2$ in He at 800 cc/min. The feeder was kept on at the continuous mode for 1 h (400 feeds/injections) or 20 min (3000 feeds/injections) for the tests with 9 and 0.4 s injection intervals, respectively.

Figure 5:
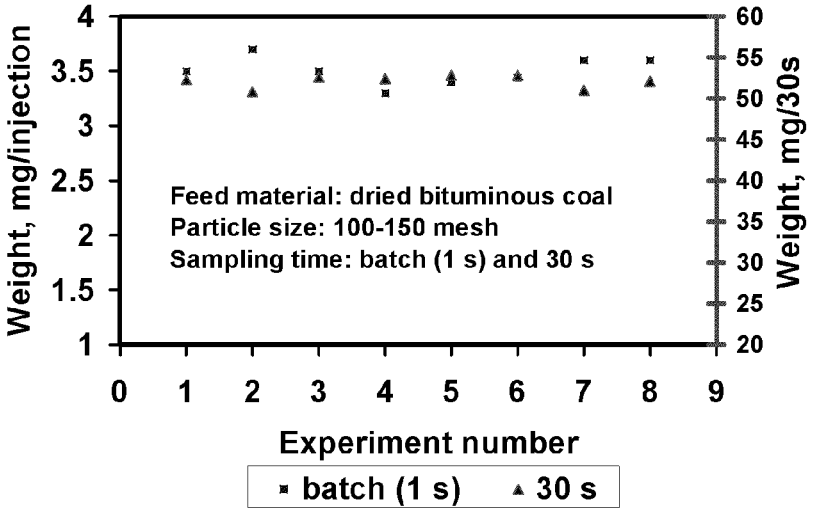
FIG. 5 is a graph showing results of feedings in batch (one 1-s opening in each injection) and continuous (15 consecutive 1-s injections) modes before connecting the feeder to the reacting system, where fluctuations are found to be within 5%.

FIG. 5 illustrates the measured particle weights from batch and continuous feedings when the feeder is operated independently, not engaged with the reactor. The weights of particles from these two methods are within 5% fluctuations. The average feed rate at continuous mode is 3.473 mg/s, which is only 0.9% different from that calculated based on batch mode, 3.500 mg/s. It was noted that the feed rate is indeed reasonably uniform during the continuous mode.

Figure 6:
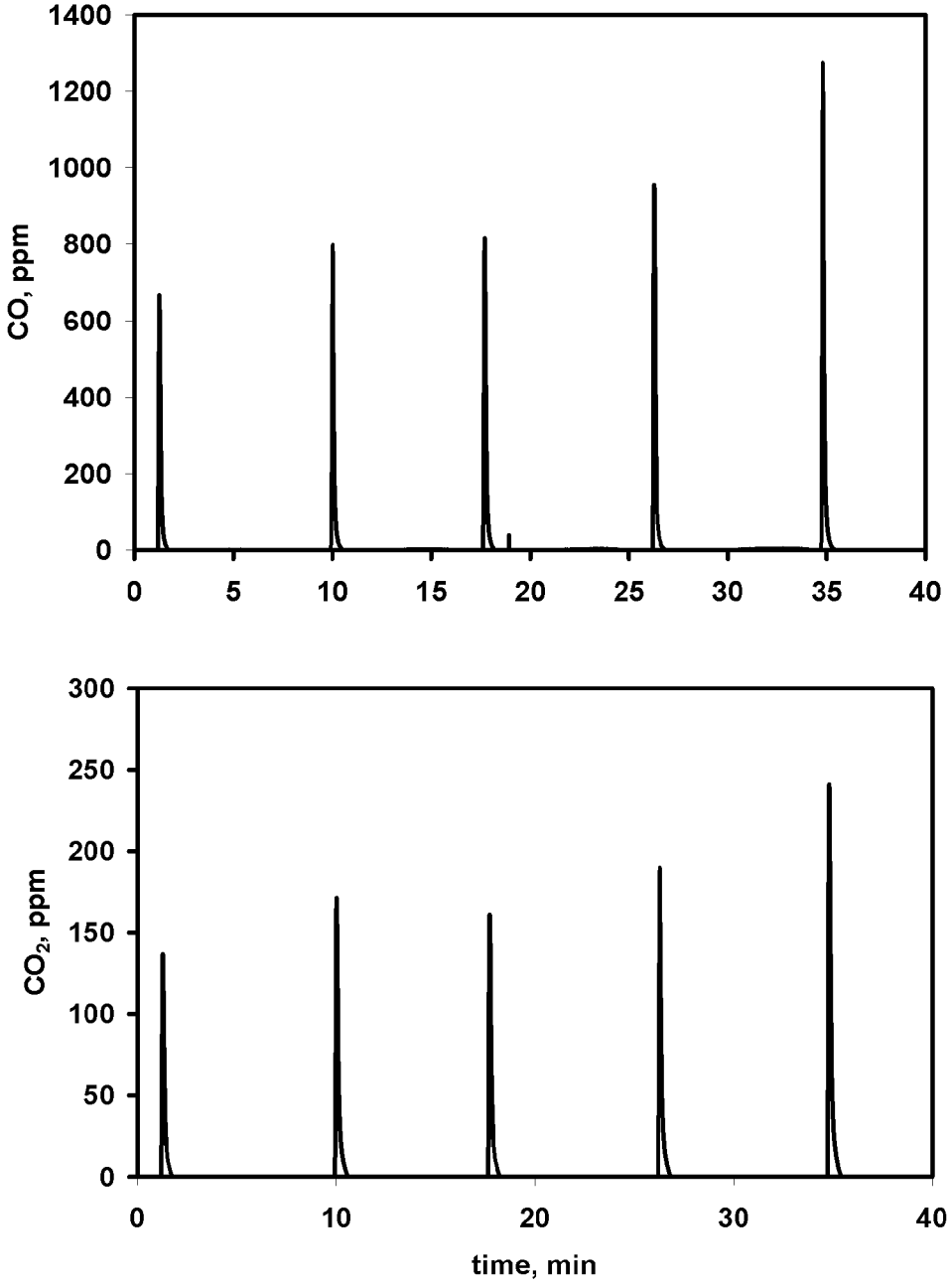
FIG. 6 includes graphs showing CO, $CO_2$ yield from coal pyrolysis after batch injection with the gas inlet adjacent to the valve, with results showing poor reproducibility.

When the feeder was initially placed in communication with the reactor for pyrolysis, gas was fed horizontally on one side of the tube adjacent to the needle hole. FIG. 6 shows CO and $CO_2$ yields during pyrolysis of batch feeding of coal particles at 850° C. These five peaks show poor reproducibility. Indeed, the fluctuations are more than 25% and not acceptable. The swirl flow created by the gas stream effected the stability of the particles near the needle. In accordance with Bird et al.[8] the entrance length can be estimated based on the following formula:

$$L_e = 0.035DRe,$$

where $L_e$ is the entrance length, D is the diameter, and Re is the Reynolds number of the fluid. Thus, the gas feed position was moved about 3 in. below the hole defined by the reservoir.

Figure 7:
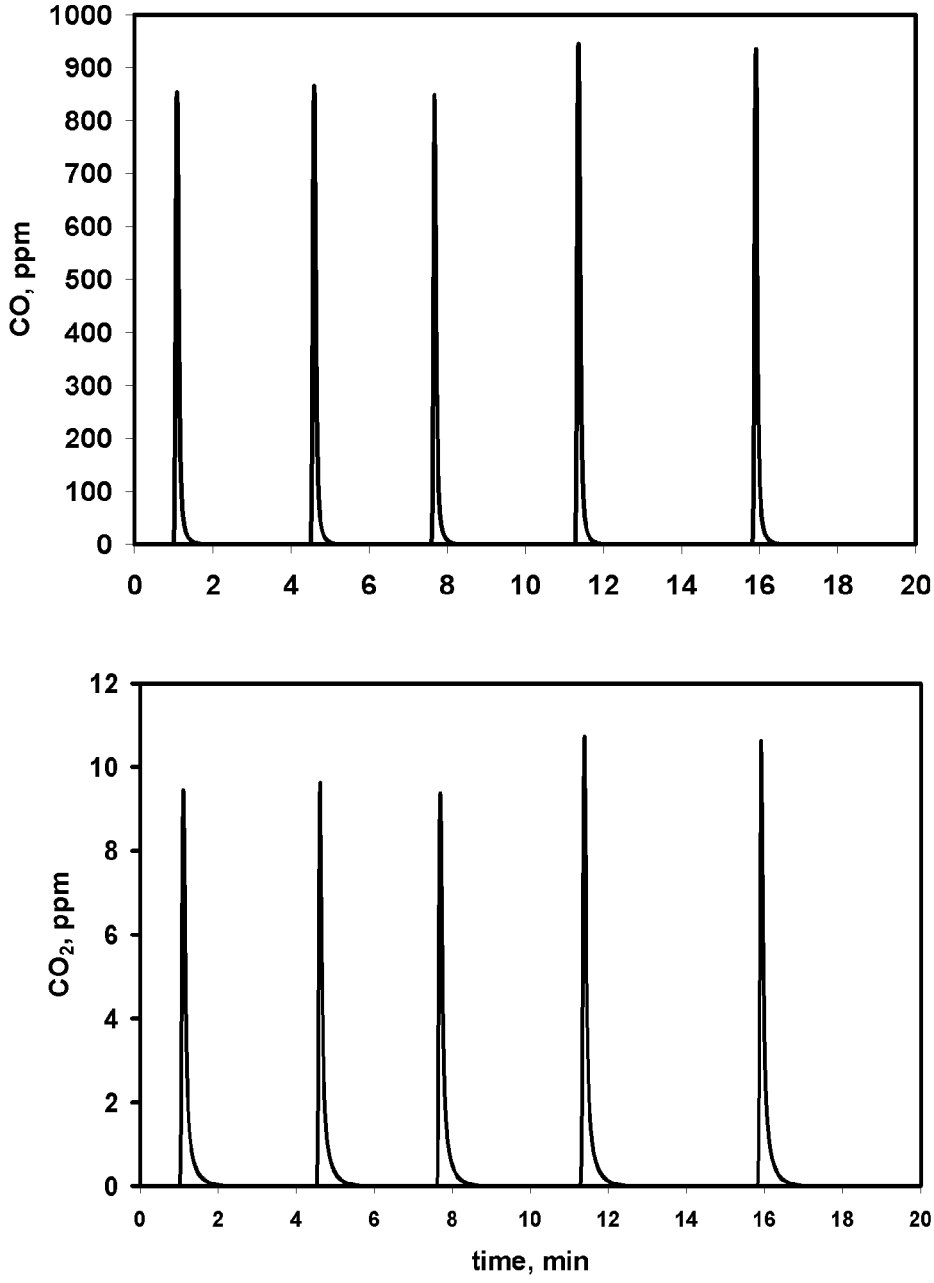
FIG. 7 includes graphs showing CO, $CO_2$ yield from coal pyrolysis after batch injection with the gas fed 3 in. below the valve, where pyrolysis was conducted in 850° C. with 800 cc/min He flow, and where reproducibility is within 6.5%.

FIG. 7 presents CO and $CO_2$ yields for batch feeding after the gas feed position was moved. This modification notably increased the reproducibility. The fluctuations were reduced from 25% to 6.5%. However, this modification is unable to totally avoid the disturbance caused by the gaseous flow horizontally fed from a side tube. The fluctuations are particularly notable when flow rate is high and particles are fine. In order to improve the stability further, a transport tube was placed in communication with the hole defined by the reservoir, such that particles exiting the reservoir fall through the transport tube before mixing with the gas. A ⅛ inch transport tube was used, through which the particles fell before mixing with the gas in a ¼ inch tube. A flow distributor (honeycomb straightener) was installed before the particles and gas meet.

Figure 8:
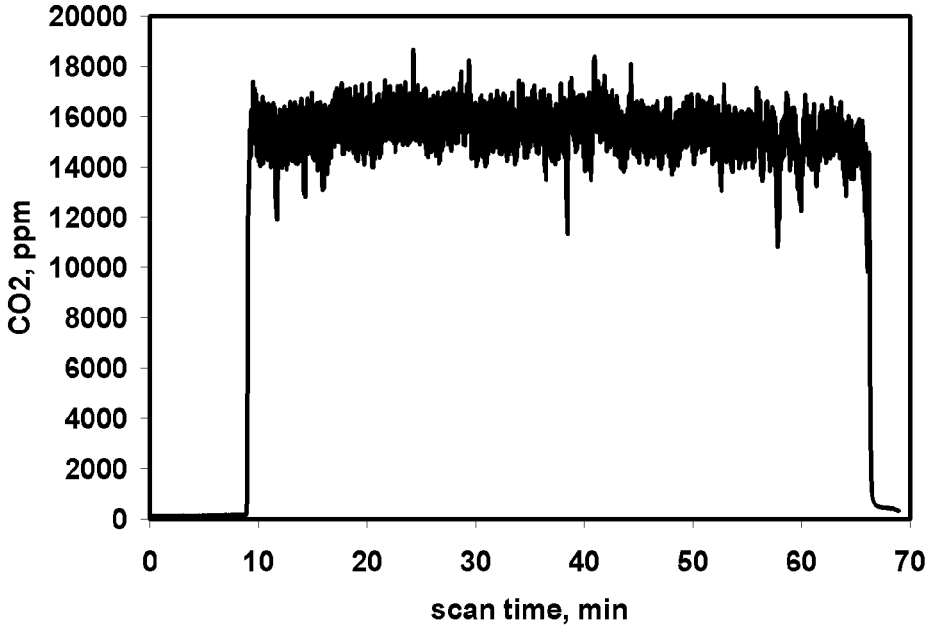
FIG. 8 is a graph that shows $CO_2$ yields from coal oxidation after continuous injection of a bituminous coal for 1 hour with an injection every 9 seconds, where oxidation was conducted at 900° C. with 800 cc/min of He with 2% $O_2$.

FIG. 8 shows the $CO_2$ yields from the continuous feeding after increasing the distance between gas inlet and the hole defined by the reservoir. The stabilities are determined by examining the variations in concentrations of $CO_2$ collected over 1 h periods experiment. $CO_2$ peaks arrive every 9 s, which correspond to the feeds/injections. They are not the fluctuations, or errors in the injections. Diffusion in the transfer line causes peaks less differentiable from each other. During the 1 h period, there is about 824.9 mg coal that has been injected with a feeding rate of 2.0 mg/injection, where 17% of carbon is burnout. A small decrease in the feed rate toward the last 30% of the experimental period may have been caused by the decrease in density; over 40% of the particles were injected during the 1 h period. For applications where a longer run time is desired, a secondary reservoir can be used to improve this issue.

Figure 9:
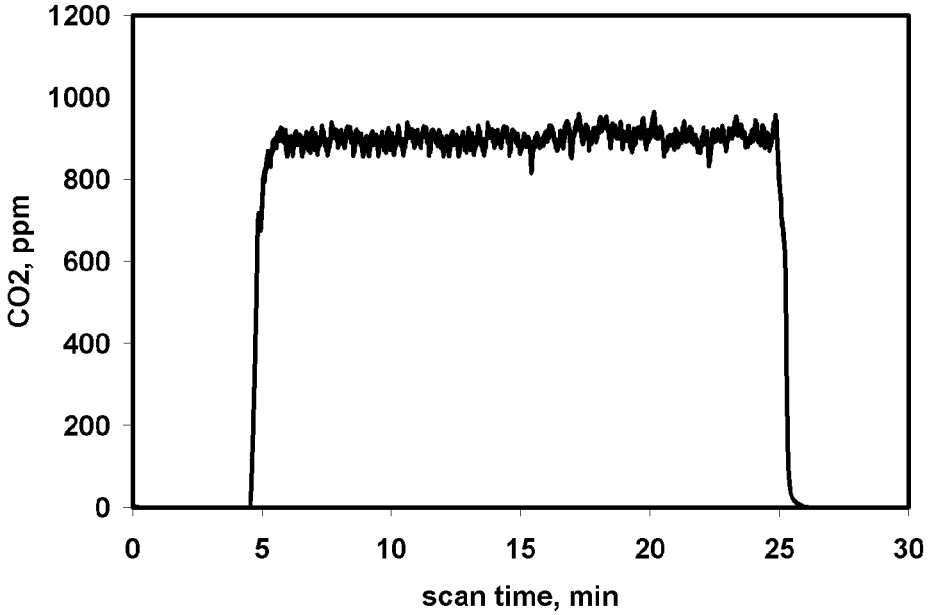
FIG. 9 is a graph that shows $CO_2$ yields from coal oxidation after continuous injection of a lignite coal for 20 min with an injection every 0.4 seconds, where oxidation was conducted at 900° C. with 800 cc/min of He with 1% $O_2$.

FIG. 9 shows $CO_2$ yields from coal oxidation after continuous injection of a lignite for 20 min with an injection every 0.4 seconds. The average feed rate is about 20 mg/min. Feed rate at such high frequency is more uniform than that at 9 s per injection, and the fluctuation observed on the mass spectrometer is less than ±3%. The observed $CO_2$ peaks shown in FIG. 9 do not represent the actual injections. In this particular test, about 400 mg of coal is fed with an average feeding rate of 20 mg/min, where 25% of its carbon has been burned.

It is contemplated that the frequency of injection and stability of the feed rate can be further increased from that shown with the exemplary embodiment used for tests described in Example 1 using, for example, a more powerful solenoid to pull the rod to its opening position, and/or a mechanism for pulling the rod down into the closed position, e.g., a second solenoid, or a spring around the rod (metal or plastic, as long as it has a magnet and seals the nozzle tightly) to urge the rod to the closed position.

Features capable of controlling the feed rate include, the timer, the vertical traveling distance of the rod in the reservoir, and the size of the hole defined by the reservoir. When the opening time period or the hole of valve decreases, the feed rate decreases. Particle size can also influence feed rate. It is observed that feeding rate increases when particles of more uniform size, i.e., between 120 and 140 meshes, are fed.

The diameter of the hole defined by the reservoir is useful in keeping the feeding rate steady, particularly when particles are smaller than 100 μm. Holes having a diameter of about 1/16 inch have been tested favorably with particles smaller than about 100 μm. When the hole has a diameter of about ⅛ in, a high feed rate results with particles that are smaller than 100 μm, and a feed rate below 1 gram/hour is not achieved. If the diameter of the hole is too small, particles tend to block the hole. Feeding of small particles at a uniform rate can be facilitated by providing a smooth internal wall of the reservoir and/or floor of the reservoir.

The range of feed rate can be extended as the diameter of the hole defined by the reservoir is increased or decreased within its operating range. When the size of the hole is selected, adjusting the vertical traveling distance of the rod inside the reservoir can achieve a wide range of feed rates. The longer the traveling distances, the higher the feed rate that can be achieved. When the achieved rate approaches the desired rate, the rate can be further tuned by adjusting the timer parameters, i.e., the on and off periods of the actuator. Shortening the off-periods of the timer, which increases the time that the rod of the valve is in the open position, increases the feed rate. For example, when the on/off periods are sets at 0.08 s/0.4 s, the feed rate is about 4 mg/min. When the on/off periods are sets at 0.12 s/0.14 s, the feed rate increase to 800 mg/min.

The embodiment of the particle feeder and system used in the presently-described test has been tested with fine particles of 45-75 μm with feeding rate varying from 0.2 gm/hour to 1 gm/min. This range of feed rate is achieved by adjusting the on/off periods of the timer.

It was observed that dried particles can be most readily fed using the particle feeder. A vibrator was not used because it was evidence was determined that vibration actually enhanced the density of the particle bed, and clogging at the hole defined by the reservoir.

The pressure differential across the hole of the valve can affect the feed rate and the uniformity of the feed rate. When the pressure differential is greater than 7 psig, uniformity is sacrificed. Testing indicated that the best reproducibility for dried small particles can be achieved when the pressures on both sides of the hole are kept identical.

The exemplary gravity-driven, solenoid/timer-regulated particle feeders described herein are capable of feeding pulverized particles at low and uniform rates. They require no aspirating gas, do not have external moving parts, are protected from flow disturbance as particle flow through the hole defined by the reservoir, and are protected from leakage at the hole defined by the reservoir when the rod is in the closed position. Embodiments of the particle feeder have been found to be effective in systems for conducting combustion experiments, where dried pulverized coal particles of about 100 μm are fed over a wide range of feed rates. The particle feeder can be scaled up or down for other kinds of particles at other desirable ranges of size and feed rate. Feed rates can be readily controlled and calibrated. The particle feeder is capable of feeding particles of at either batch or near continuous mode. The particle feeder can also be adapted for feeding liquids or particles that have been suspended in liquids. Single-particle injection at a desired time is also feasible. Addition information relevant to the exemplary particle feeder used for tests described in this Example is described in W. Y. Chen, G. Gowan, G. Shi, and S. Wan, *Rev. Sci. Instrum.* 79, 083904 (2008), which is incorporated herein by this reference.

Example 2

An embodiment of the particle feeder was selected for testing long-term operation, which requires larger quantities of particles. A reservoir having a length of about 8 cm, having a capacity for more than 12 grams of coal particles was provided. The length of the rod of the valve was provided in a length for operation within the provided reservoir. A powerful solenoid actuator was used, Model SS251 12 V starter solenoid available from Standard Motor Products. The power source needed to drive the actuator was 100 W, much higher than the maximum output from the 15 W timer being used. Therefore, the timer was unable to control the solenoid directly, and a relay 192 was added, as illustrated in FIG. 4. The relay, Omega SSRDC 100 VDC20, had a low voltage output connected to the timer and a high voltage output to the solenoid side. A single power supply 190, Antec Basiq 350 Watt (BP350), was installed and modified to provide power to the timer 130, relay 192, and actuator 128, as illustrated in FIG. 4.

To maintain uniform bed density, particles were stirred by placing piecewise metal wires around the rod with short, regular intervals, and the ends of each piece of wire were extended into the particle bed to prevent caking during feeding. A ferrous valve rod was selected for its beneficial durability, and to enhance interaction with the solenoid actuator.

This embodiment was tested for long-term operation capacity with coal particles, which were placed into the reservoir, forming a particle bed. Although the features described in the foregoing paragraph were able to keep the valve rod from jamming in the voluminous particle bed, and feed rate was initially found to be stable (i.e., under short-term operation); under long-term operation, the uniformity in feed rate was less than desirable. Therefore, another exemplary embodiment of the particle feeder was designed for applications requiring long-term operation (e.g., more than about 1, 2, 3, 4, or 5 hours).

With reference to FIG. 4, an exemplary embodiment of the particle feeder 100 including a secondary reservoir 113 was designed for applications requiring long-term operation. Embodiments making use of the secondary reservoir can also be used for other applications, where shorter-term operation is desired.

The secondary reservoir was contemplated to serve multiple purposes, including: (1) capacity for large quantities of particles, which are needed for long-term operation; (2) minimizing the particle bed height and density variations in the primary reservoir during operation; (3) reducing particle residence time in the primary reservoir, thereby minimizing particle attrition due to rod motion, and (4) ability to replenish particle supply during operation of the feeder.

Figure 10:
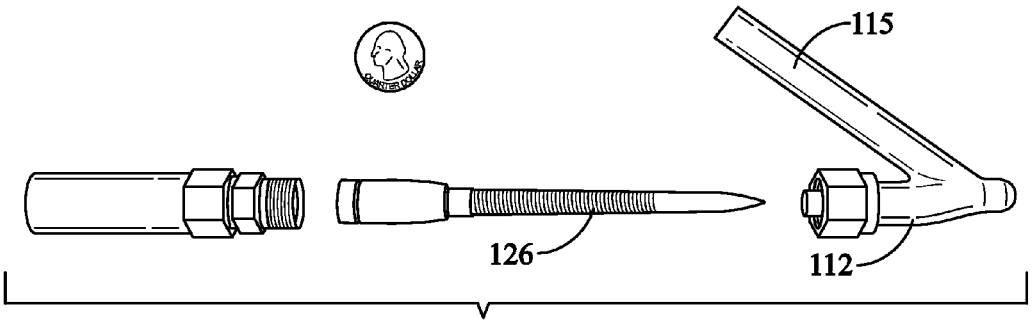
FIG. 10 is a photograph of portions of an embodiment of a particle feeder as described in the present application.
Figure 11:
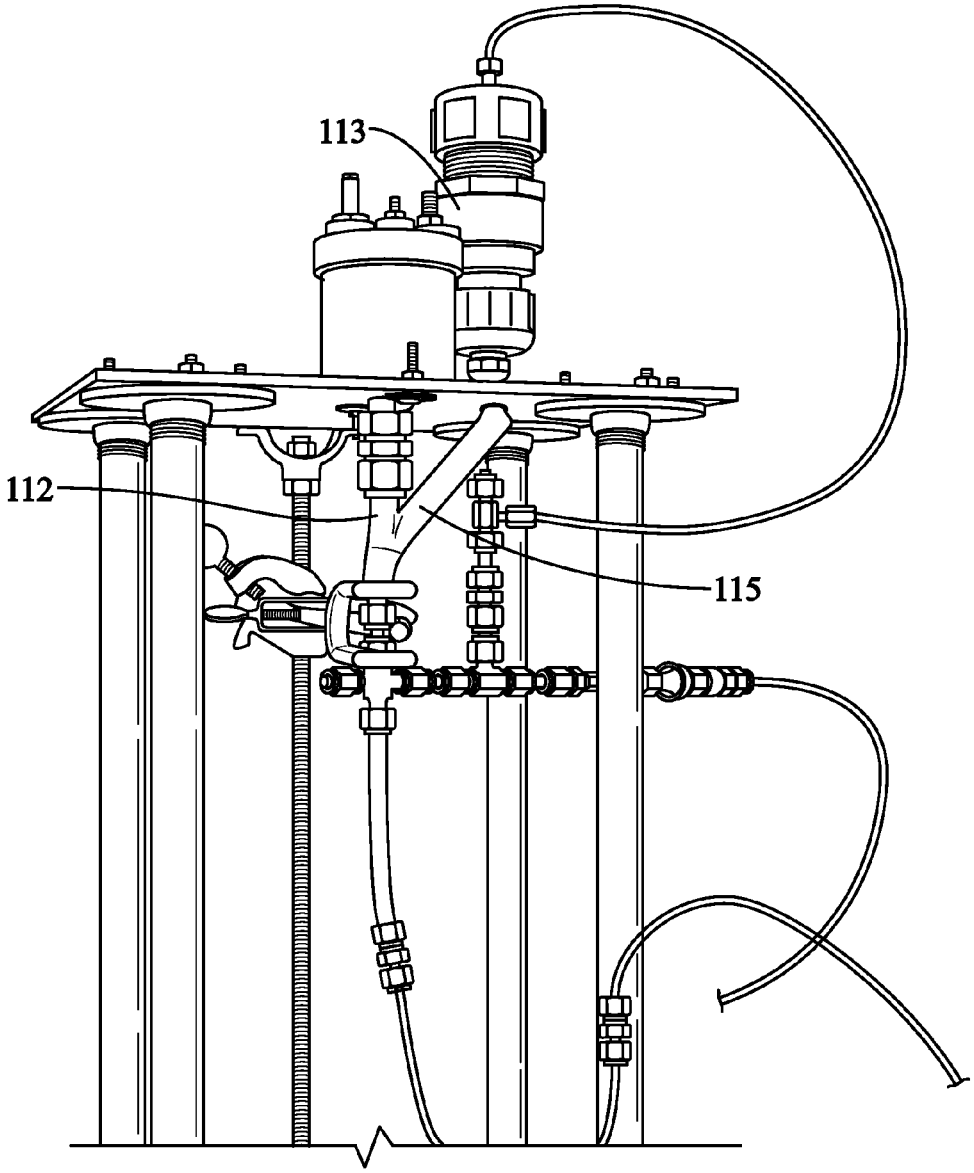
FIG. 11 is a photograph of an embodiment of a particle feeder as described in the present application.

With reference to FIGS. 4, 10, and 11, a conduit 115 was used to place the secondary reservoir 113 in fluid communication with the primary reservoir 112. In the exemplary embodiment, a conduit of 0.635 cm o.d. was selected. A first end of a conduit 115 was attached at the lower end of the primary reservoir 112 at a 30-degree angle. A second end of the conduit 115 was attached to the secondary reservoir 113 by a flexible hose. The particles in the secondary reservoir were allowed to continuously fall into the primary reservoir during the operation. To maintain uniform density of the particle bed and minimize the particle attrition in the primary reservoir, the conduit was placed to allow flow into the primary reservoir at a location relatively close to the hole defined by the primary reservoir, e.g., about 1.2 cm. In the exemplary embodiment, a primary reservoir of 4.85 cm length and 0.635 cm o.d. was orivuded.

With reference to FIG. 10, in the exemplary embodiment, the valve rod 126 was constructed from ferrous material, and was provided in a diameter designed to reduce load and a length of about 14.5 cm, which was shorter that the rod length of the exemplary embodiment described earlier in this Example. Due to the reduction in particle bed height and particle residence time in the primary reservoir, the metal wires around the rod, as used in the exemplary embodiment described earlier in this Example, were deemed unnecessary.

Since the rod motion is induced by a magnetic field in the exemplary embodiment, the shortened rod suffers lesser effects resulted from any imprecision in aligning the rod with the magnetic field. Studies indicate that improved results are obtained when the solenoid actuator is placed horizontally, and the rod is placed vertically, in the center of the solenoid. Imprecise alignment can result in wobbling of the rod during feeding, which, in turn, results in unstable feed rate.

To minimize the pressure difference between the primary reservoir and downstream internal areas in a system incorporating the exemplary feeder, gas can be fed into the top of the secondary reservoir, as well as into the downstream internal area of the system, below the hole defined by the primary reservoir. In this embodiment, there is no need to feed gas into the primary reservoir because it is designed to be operated under a steady state condition. In other embodiments, it can be useful to feed gas into the primary reservoir. In the exemplary embodiment, particles exit from the primary reservoir and enter a transport tube, e.g., a 0.317 cm o.d. stainless steel tube. A carrier gas enters the downstream internal area of the system from the side into a system tube, e.g., a 0.635 cm i.d. stainless steel tube, which encloses the transport tube. Particles fall through the transport tube, past the gas inlet. In this manner, the movement of gas at the gas inlet does not disturb flow of the particles.

Particles can be transported by gas further through the system, downward and upward in a flexible hose, which can include segments that are sequentially smaller in size. When the particles are transporting upward into a smaller hose, to prevent particle accumulations just before a reducer, it is recommended that gas always flow upward through the 0.1587 to 0.3175 cm reducer in the down stream of the feeding device. In the event carrier gas is not desirable, particles can fall freely from the transport tube. In such embodiments, a cap of the secondary reservoir can be left open to minimize the pressure difference, and secondary gas will not be needed.

Figure 12:
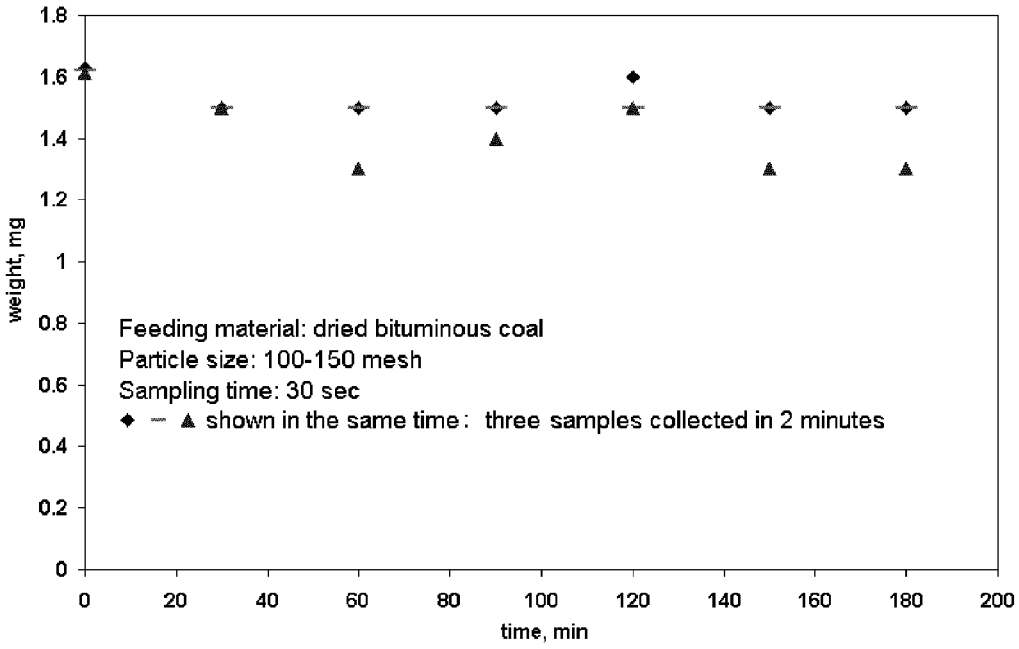
FIG. 12 is a graph showing results of a test where an embodiment of the particle feeder was operated for 3 hours.
Figure 13:
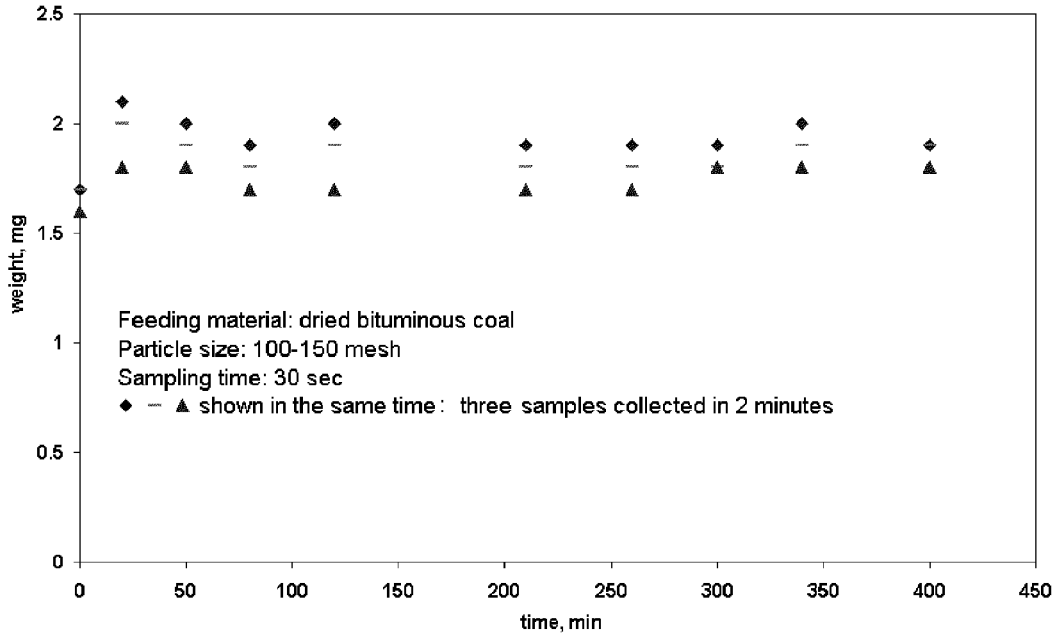
FIG. 13 is a graph showing results of a test where an embodiment of the particle feeder was operated for 7 hours.

The exemplary embodiment of the particle feeder, including the secondary reservoir, was tested for long-term operation. Tests were performed for 3, 4, and 11 h, all with dried bituminous coal particles of 100 to 150 μm. The timer's on/off times were set at 0.01/0.3 s. Particles exiting the primary reservoir were urged upward with He gas flowing at 200 ml/min through a tube with 0.159 cm o.d. Samples were collected for 30 s and then weighted. Three consecutive samples were collected, each within 2 min, for about every 30 min. FIGS. 12 and 13 present results from a 3-h test, and a 7-h test, respectively. For the data in FIG. 12, the standard deviations associated with the short- and long-term stabilities are 0.031 and 0.095 mg/min, respectively. The mean feed rate is 1.49 mg/min. For the data in FIG. 13, the standard deviations associated with the short- and long-term stabilities are 0.033 and 0.12 mg/min, respectively. The mean feed rate is 1.84 mg/min. It is noted that the chosen feed rate is low for this set of experiments, and the percentage fluctuations (relative to their mean) improve when the device is operated at higher feed rates. Assuming the feed rate is the random variable, the mean and variances of each data set i, $\{x_{ij}\}$, are estimated by the following formulas, respectively, $$\mu_i = \frac{1}{n}\sum_{j=1}^{n} x_{ij} \tag{1}$$

and $$\mathrm{var}(x_i) = \frac{\sum_{j=1}^{n}(x_{ij}-\mu_i)^2}{n-1} \tag{2}$$

where n is the number of data points in the set $\{x_{ij}\}$. Assuming the collection of particle samples within a short time, e.g., 2 min in the present example, is an independent and identically-distributed random variable, and x is the sum of a set of m independent random variables (See J. E. Freund, *Mathematical Statistics,* $2^{nd}$ ed. (Prentice Hall, New jersey, 1971), p 196), i.e., $$x = \frac{1}{m}(x_1 + x_2 + \ldots + x_m) \tag{3}$$

then the mean and variance associated with the random variable x are, respectively, $$\mu = \frac{1}{m}\sum_{i=1}^{m}\mu_i \tag{4}$$

and $$\mathrm{var}(x) = \left(\frac{1}{m}\right)^2 \sum_{i=1}^{m}\mathrm{var}(x_i) \tag{5}$$

The square root of the var(x) in the above expression, or the standard deviation, is an index of short-term stability. Note the short-term stability depends on the mean of each data set, but not the overall mean.

Long-term stability considers all data points, and the mean and variance of long-term stability are $$\mu = \frac{1}{nm}\sum_{i=1}^{m}\sum_{j=1}^{n}x_{ij} \tag{6}$$

and $$\mathrm{var}(x) = \frac{\sum_{i=1}^{m}\sum_{j=1}^{n}(x_{ij}-\mu)^2}{mn-1} \tag{7}$$

The square root of the var(x) in the above expression is called long-term stability.

The results discussed above suggest that the exemplary embodiment of the particle feeder as described in this example can achieve both short- and long-term uniform feed rates.

Throughout this document, various references are mentioned. All such references are incorporated herein by reference, including the references set forth in the following list:

REFERENCES

H. Kobayashi, "Devolatilization of Pulverized Coal at High Temperatures," PhD Dissertation, Department of Mechanical Engineering, Massachusetts Institute of Technology, June, 1976.

Y. H. Song, "Fate of Fuel Nitrogen during Pulverized Coal Combustion," PhD Dissertation, Department of Chemical Engineering, Massachusetts Institute of Technology, June, 1978.

P. R. Solomon, and D. G. Hamblen, "Analysis of Coal Devolatilization in a Laboratory-Scale Entrained Flow Reactor," Fianl Repor AP-2603 under EPRI Project 1654-8, Electrical Power Research Institute, Palo Alto, Calif., July, 1983.

T. E. Burch, R. B. Conway, and W. Y. Chen, Rev. Sci Instrum. 62, 480 (1991).

L. Tang, and W. Y. Chen, Rev. Sci Instrum. 70, 3143 (1999).

R. A. Dictor, "Determination of Complete Temperature Profiles of Singly Burning Pulverized Fuel Particles," M. S. thesis, Massachusetts Institute of Technology, 1979.

W. Y. Chen, S. Wan, and G. Shi, "Stable Surface Oxides on Chars and Impact of Reactor Materials at High Temperatures," submitted to Energy and Fuel (2006).

R. B. Bird, W. E. Stewart, and E. N. Lightfoot, Transport Phenomena, 2nd ed., p. 53 (2001).

W. Y. Chen, G. Gowan, G. Shi, and S. Wan, Rev. Sci. Instrum. 79, 083904 (2008).

What is claimed is:

1. A system, comprising:

(a) a particle feeder, having (i) a primary reservoir enclosing an internal volume for holding particles and defining a hole through a bottom surface thereof; and (ii) a valve, including a rod enclosed within and extending through the volume defined by the primary reservoir, said rod being movable between an open position, wherein particles can flow through the hole, and a closed position, wherein the rod blocks the hole, an actuator for controlling movement of the rod between the open position and the closed position, wherein the actuator is a solenoid actuator, and a timer for controlling the actuator; and (b) a reactor, having an internal area placed in fluid communication with the internal volume of the primary reservoir, such that particles flowing through the hole can enter the internal area of said reactor; and further comprising (i) a first line in fluid communication with the internal volume of the primary reservoir, for exposing the internal volume of the primary reservoir to a gas or a vacuum;

(ii) a second line in fluid communication with the internal area of the reactor for exposing the internal area of the reactor to the gas or the vacuum;

(iii) an equilibrium line placed in fluid communication with the first and second lines; and (iv) a series of valves for controlling exposure of the internal volume of the primary reservoir and the internal area of the reactor to the gas or the vacuum.

2. The system of claim 1, and further comprising an analytical instrument operably connected to the reactor.

3. The system of claim 1, wherein the particle feeder further comprises a secondary reservoir having an internal volume, and a conduit for connecting the internal volume of the secondary reservoir with the internal volume of primary reservoir, such that particles can flow from the secondary reservoir into the primary reservoir.

4. The system of claim 1, wherein the primary reservoir further includes:

a substantially conical floor, with an internal lateral surface directed downward towards an apex, said hole being defined at the apex;

a removable cap for providing access to the internal volume of the primary reservoir, wherein the cap can be positioned at different heights above the hole to adjust a traveling distance of the rod when the rod is moved between the open position and the closed position; and wherein the rod further comprises a substantially conical tip for nesting within the apex of the floor, thereby sealing the hole in the closed position;

wherein the rod can be adjusted to different lengths to adjust a traveling distance of the rod when said rod is moved between the open position and the closed position.

5. The system of claim 1, wherein the primary reservoir further includes a substantially conical floor, with an internal lateral surface directed downward towards an apex, said hole being defined at the apex.

6. The system of claim 5, wherein the rod includes a substantially conical tip for nesting within the apex of the floor, thereby sealing the hole in the closed position.

7. The system of claim 1, wherein the primary reservoir further includes a removable cap for providing access to the internal volume of the primary reservoir.

8. The system of claim 7, wherein the cap can be positioned at different heights above the hole to adjust a traveling distance of the rod when the rod is moved between the open position and the closed position.

9. The system of claim 8, wherein the rod further comprises a substantially conical tip for nesting within the apex of the floor, thereby sealing the hole in the closed position;

wherein the rod can be adjusted to different lengths to adjust a traveling distance of the rod when said rod is moved between the open position and the closed position.

10. The system of claim 1, wherein the rod can be adjusted to different lengths to change a traveling distance of the rod when said rod is moved between the open position and the closed position.

11. The system of claim 1, wherein the rod comprises a magnetic material.

12. The system of claim 11, where the removable cap for providing access to the internal volume of the primary reservoir is constructed from a nonmagnetic material.

13. The system of claim 11, and further comprising a second solenoid actuator for moving the rod into the closed position.

14. The system of claim 1, wherein the particles are coal particles.

15. The system of claim 1, wherein the particles are biomass particles.

* * * * *